United States Patent [19]

Cassidy

[11] Patent Number: 4,611,954

[45] Date of Patent: Sep. 16, 1986

[54] APPARATUS AND METHOD FOR MINE INSTALLATIONS

[75] Inventor: Bruce A. Cassidy, Richmond, Ohio

[73] Assignee: Republic Corporation, Century City, Calif.

[21] Appl. No.: 654,130

[22] Filed: Sep. 25, 1984

[51] Int. Cl.[4] ..... E21D 20/02; E21D 21/00; F16B 33/04

[52] U.S. Cl. ..... 405/261; 405/259; 411/5; 411/11

[58] Field of Search ..... 405/259–261; 411/1–5, 9–11, 82, 258, 302–304; 52/698, 704

[56] References Cited

U.S. PATENT DOCUMENTS

| | | | |
|---|---|---|---|
| 2,748,824 | 6/1956 | Brill | 411/302 X |
| 3,967,455 | 7/1976 | Conway | 61/45 B |
| 3,979,918 | 9/1976 | Vidler | 61/45 B |
| 4,023,373 | 5/1977 | Hipkins | 61/45 B |
| 4,100,748 | 7/1978 | Hansen | 405/259 |
| 4,122,681 | 10/1978 | Vass et al. | 405/261 |
| 4,132,080 | 1/1979 | Hansen | 405/261 |
| 4,347,020 | 8/1982 | White et al. | 405/5 X |
| 4,413,930 | 11/1983 | Calandra, Jr. | 405/261 |
| 4,419,805 | 12/1983 | Calandra, Jr. | 29/458 |
| 4,477,209 | 10/1984 | Hipkins | 405/261 |
| 4,483,645 | 11/1984 | White et al. | 405/259 X |
| 4,501,515 | 2/1985 | Scott | 405/259 |

*Primary Examiner*—Cornelius J. Husar
*Assistant Examiner*—Nancy J. Stodola
*Attorney, Agent, or Firm*—Fleit, Jacobson, Cohn & Price

[57] ABSTRACT

An apparatus and method for anchoring a bolt in a bore hole in a rock formation is disclosed. A tensioning assembly, which comprises a tensioning plug and expandable sheath, is threadedly engaged to the end of an elongated bolt. A ring is securely affixed to the inner wall of the plug at a predetermined point adjacent the plug's threaded portion. The end of the bolt abuts the ring upon assembly, thereby causing the bolt and the tensioning assembly to rotate together upon application of a torque to the bolt. This rotational movement effects mixing of bonding material which is placed in the bore hole ahead of the tensioning assembly. As the mixed bonding material begins to harden, rotation of the tensioning assembly is resisted. Upon application to the bolt of a torque in excess of a predetermined torque, the bolt will deform the ring located in the plug by cutting threads therein, thereby causing relative rotation of the bolt, the plug is non-rotatably drawn axially along the bolt so as to expand the sheath extensions, thereby placing them in contact with the bore hole walls. The resin mixture then bonds the entire assembly to the rock formation, thereby resisting downward movement of the sheath and allowing the bolt to be tensioned upon further rotation.

12 Claims, 8 Drawing Figures

APPARATUS AND METHOD FOR MINE INSTALLATIONS

BACKGROUND OF THE INVENTION

This invention relates to an apparatus and method for anchoring a bolt in a rock formation, and, more particularly, to a tensioning assembly adapted for use with a bonding material.

It is well-known in the art of mine roof support to utilize systems which combine mechanical anchoring and resin anchoring. Typically, the system has an expansion shell assembly threadedly engaged to the end of a bolt which includes a roof support plate. A camming plug, used in combination with an expansion shell, usually employs a displaceable stop means to prevent axial movement of the bolt beyond a certain point in the plug when the effective torque applied to the bolt is below a certain level. Resin components are then inserted into the bore and the entire roof support assembly is placed immediately beneath them. Mixing of these components is accomplished by rotating the bolt, thereby causing the shell assembly similarly to rotate.

As the resin hardens, rotation of the shell assembly is resisted, thereby allowing the torque applied by the bolt to the displaceable stop means to exceed a predetermined level. This action displaces the stop means and permits relative rotational movement between the shell assembly and the bolt. Upon continued rotation of the bolt in the same direction, the plug advances axially along the bolt, expanding the shell into engagement with the bore hole. Once the resin is hardened, the bolt can be tensioned in the bore hole.

One of the major shortfalls of these systems lies in the construction of the stop means. The most familiar stop means is in the form of a shearable pin which breaks upon application of a preselected torque. Severe problems exist in practice, however, in determining the proper material and associated pin dimensions for constructing a pin which reacts to stress as planned. As a result, there has been little consistency in the operation of these systems, with many systems failing to operate properly in actual use.

Therefore, the principal object of the present invention is to provide a method and apparatus for combining resin bonding and mechanical anchoring of a bolt in a rock formation by a tensioning assembly provided with a resistance means which will thread in place in the assembly when a torque in excess of a predetermined value is applied to a bolt abutting the resistance means.

Another object is to provide a resistance means which is tapped by a bolt upon application of a torque in excess of a predetermined torque.

SUMMARY OF THE INVENTION

The foregoing and other objects of the invention are achieved by providing an apparatus including an elongated bolt adapted for use in a bore hole. A tensioning assembly, which comprises a tensioning plug and expandable sheath, is threadedly engaged to the end of the bolt. A ring is securely affixed to the inner wall of the plug at a predetermined point adjacent the plug's threaded portion. The end of the bolt abuts the ring upon assembly, thereby causing the bolt and the tensioning assembly to rotate together upon application of a torque to the bolt. This rotational movement effects mixing of bonding material which is placed in the bore hole ahead of the tensioning assembly.

As the mixed bonding material begins to harden, rotation of the tensioning assembly is resisted. Upon application to the bolt of a torque in excess of a predetermined torque, the bolt will deform the ring located in the plug by cutting threads therein, thereby causing relative rotational movement between the plug and the bolt. Upon continued rotation of the bolt, the plug is non-rotatably drawn axially along the bolt so as to expand the sheath extensions, placing them in contact with the bore hole walls. The resin mixture then bonds the entire assembly to the rock formation, thereby resisting downward movement of the sheath and allowing the bolt to be tensioned upon further rotation.

DESCRIPTION OF THE PREFERRED EMBODIMENT

Figure 1:
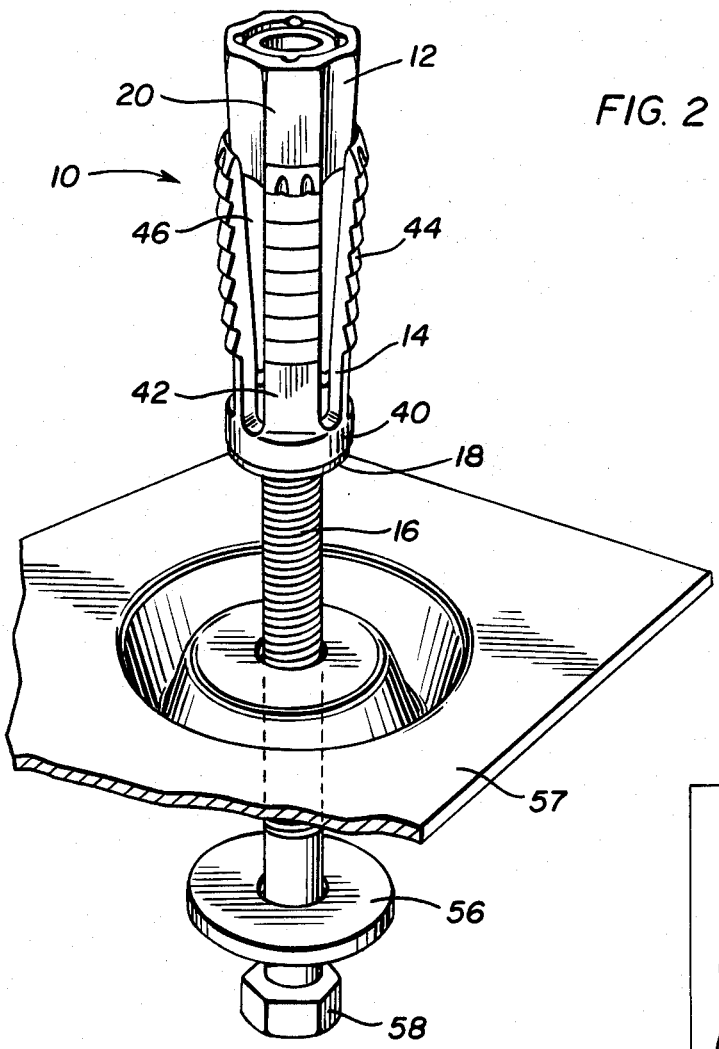
FIG. 1 is a view of a tensioning assembly, positioned on the threaded end of a bolt, comprising a tensioning plug including a threadable resistance means abutting the bolt, and an expandable sheath.
Figure 6:
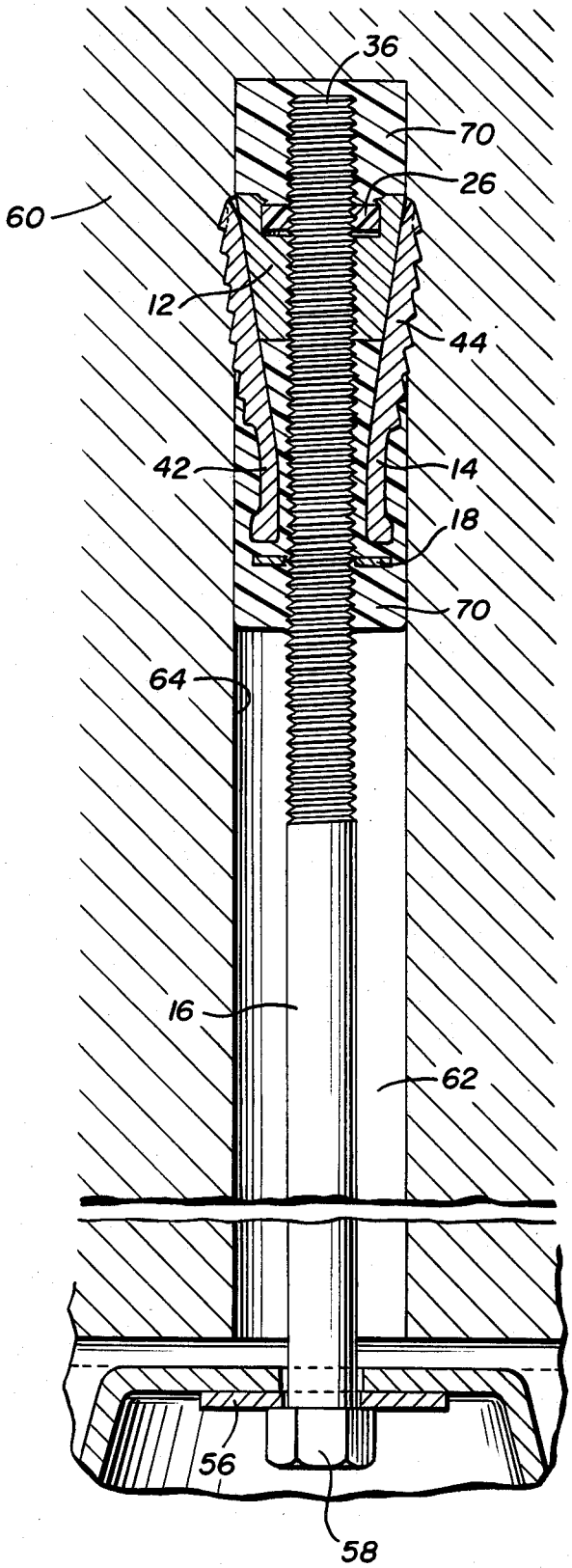
FIG. 6 is a view similar to FIG. 5 illustrating the final position of the assembly in the bore hole wherein the resistance means has been tapped by the bolt.

Referring now to FIGS. 1 and 6, there is shown the tensioning assembly of the present invention, generally designated by the numeral 10, for anchoring a bolt in a bore hole in a rock formation. Assembly 10, which includes a tensioning plug 12 positioned in abutting relationship with an expandable sheath 14, is positioned on the end of an elongated bolt 16 and threadedly engaged therewith by means of inner threads 34 in the plug 12. Assembly 10 is then inserted in a bore hole 62 for use in combination with a bonding material 66.

Expandable sheath 14 includes a base 40 with a plurality of longitudinal extensions 42 extending therefrom which together define an aperture 50 through sheath 14. Extensions 42, separated by slots 46, have a plurality of gripping projections 44 on their outer walls for gripping the wall 64 of the bore hole 62 upon expansion of the sheath 14 by the plug 12. Although four extensions 42 are used in the preferred embodiment, any number consistent with the purposes of the sheath 14 may be used.

Before tensioning assembly 10 is placed on the bolt 16, plug 12 is placed in abutting relationship with the inner surface 52 of sheath extensions 42. Plug 12 as illustrated has a plurality of flat, angled support faces 20, corresponding to each extension 42, such that the bottom portion of plug 12 fits within the sheath aperture 50, with each support face 20 abutting the inner surface 52 of an extension 42. Because faces 20 are angled, only part of plug 12 rests within sheath 14, the remainder protruding from the end of extensions 42. Once in this configuration, plug 12 and sheath 14 are coaxial.

To assemble the apparatus, assembly 10 is placed on the end of bolt 16 with plug 12 threadedly engaging bolt threads 36 up to a predetermined point within plug aperture 24. Sheath 14, which abuts the support faces 20 of the plug 12, envelopes bolt 16 and is held in place by a pall nut 18 located on bolt 16 immediately below the base 40 of sheath 14. Thus, pall nut 18 is prepositioned on bolt 16 so as to abut sheath base 40 and consequently support sheath 14. Alternately, sheath 14 may be held in place by means of a bail (not shown) which connects sheath 14 to plug 12.

Figure 3:
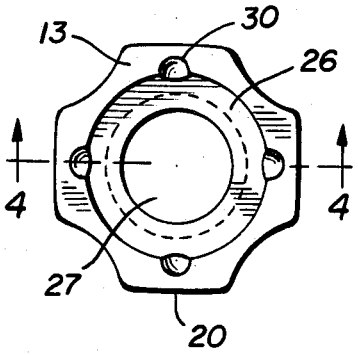
FIG. 3 is a top plan view of the tensioning plug shown in FIG. 1.
Figure 4:
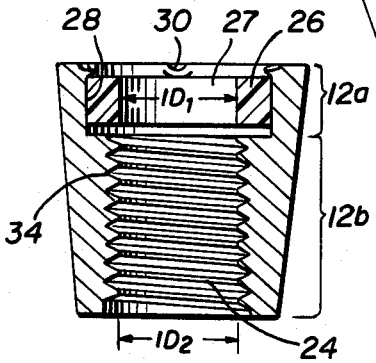
FIG. 4 is a cross-sectional view of the tensioning plug taken along line 4—4 of FIG. 3 showing the novel resistance means positioned therein.

Referring now to FIGS. 3 and 4, we see in greater detail the tensioning plug 12 including the novel resistance means. The lower portion **12*b* of aperture 24 has threads 34 which mate with bolt threads 36, while the upper portion of 12*a* houses the resistance means in the form of a threadable ring 26. Ring 26** is preferably made from a plastic material such as nylon which is threadable upon application of a predetermined force. However, it also may be constructed of any soft, malleable material which is similarly threadable.

Ring 26 may be secured to plug 12 either mechanically or adhesively. In the preferred embodiment, the ring 26 is mechanically secured in position by peening the plug top surface 13 with a metal punch (not shown), thereby forming indentations 30. Usually, the surface 13 will be peened at its inner surface at points corresponding to each support face 20, thereby deforming the metal. Because the outside diameter of ring 26 approximately corresponds to the inside diameter of the aperture upper portions **12*a*, the peening of surface 13 holds ring 26 in place. Alternately, or in combination with the above-noted method, the ring 26 may be held in place by an adhesive applied to the ring 26 outer surface and the aperture inner wall 28**.

As shown in FIG. 3, the inside diameter $ID_1$ of ring 26 approximately corresponds to the inside diameter $ID_2$ of the lower threaded portion **12*b* of aperture 24 (i.e., the minor diameter of bolt 16). Therefore, as bolt threads 36 mate with plug threads 34 and bolt 16 progresses through aperture 24, bolt 16 will encounter resistance to its axial movement when it abuts ring 26. In particular, the bolt threads 36 will abut ring 26 as they attempt to pass through the aperture upper portion 12*a*. With its axial movement thus abated, further rotation of the bolt 16 will cause simultaneous rotation of assembly 10**.

Ring 26 is designed such that, upon continuous application of a torque in excess of a predetermined torque to the bolt 16, bolt threads 36 tap the ring 26 as it remains in place in plug 12, thereby threadedly engaging ring 26 and allowing relative rotation between bolt 16 and plug 12. Bolt 16 then passes through ring opening 27, non-rotatably drawing plug 12 axially along the bolt 16.

Figure 5:
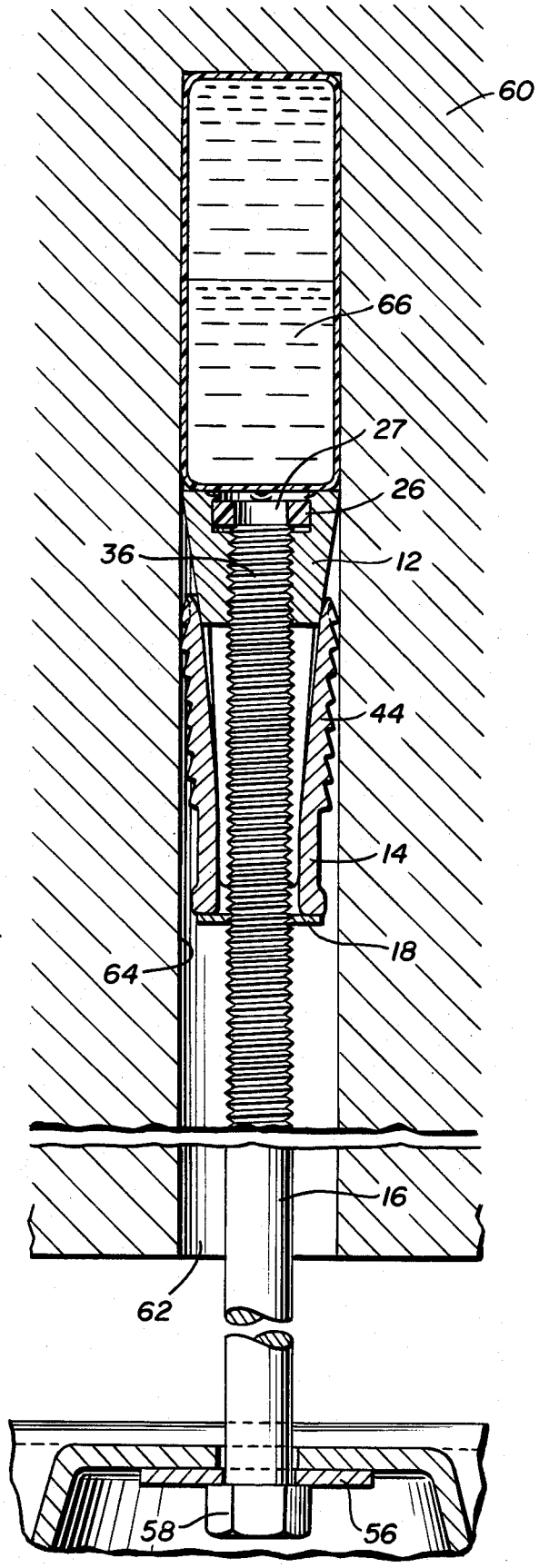
FIG. 5 is a plan view of the bolt/tensioning assembly in place of a bore hole in a rock formation, showing bonding material at the end of the bore in readiness for mixing.

FIGS. 5 and 6 illustrate the method of anchoring the assembly 10 in a bore hole 62 of a rock formation 60. First, a compartmentalized capsule 66 of unmixed bonding material (e.g., polyester resin) is placed in the bore hole 62 ahead of the tensioning assembly 10. With the assembly 10 engaging the end of bolt 16 such that bolt threads 36 abut the threadable ring 26, the entire apparatus is thrust upward in the bore hole 62 thereby rupturing the capsule 66. The resin then permeates the bore hole 62, surrounding the assembly 10 and bolt 16.

Once the capsule 66 is ruptured, bolt 16 is pushed into hole 62 such that support plate 57 rests against rock formation 60 at the entrance to bore hole 62 with the washer 56 between the bolt head 58 and the support plate 57. Bolt 16 is then rotated in a predetermined direction by means of the bolt head 58. Because threadable ring 26 prevents relative rotation between the bolt 16 and the plug 12, rotation of the bolt 16 causes simultaneous rotation of the plug 12 and sheath 14, and consequent mixing of the resin.

The resin capsule 66 preferably includes a resin (e.g., polyester) and a catalyst which are well-known in the art. As the bolt 16 is rotated, the resin and catalyst are mixed to form a curable resin mixture 70 which generally polymerizes at room temperature. Mixing is effected by the rotation of bolt 16 in one direction for approximately 10 seconds. The mixture 70 is then permitted to settle and cure for approximately 20 seconds, after which the bolt 16 is torqued. This mixing procedure may vary depending on the resin used. During this mixing process, the resin mixture 70 flows into the fissures of the rock formation 60 surrounding the bore hole 62, thereby reinforcing the rock formation 60.

As the resin mixture 70 begins to harden about the plug 12 and shell 14, it exerts a force thereon resisting rotation. When a torque in excess of a predetermined torque is applied to bolt 16 in the same direction as the initial rotation, bolt threads 36 tap into ring 26, cutting grooves on the ring 26 inside surface. Due to the continued resistance supplied by the hardening resin mixture 70, bolt 16 and assembly 10 are allowed to rotate relative to one another, causing bolt 16 to pass through plug 12 as it taps ring 26. As a result, plug 12 is non-rotatably drawn axially along the bolt 16 so as to expand the sheath extensions 42, placing them in gripping contact with the walls of the bore hole 62. When a pall nut 18 is used, this action causes sheath 14 to exert a downward force on nut 18. When this force exceeds a predetermined value, nut 18 breaks away from bolt 16, freeing sheath 14 to settle in a secure position within bore hole 62. As this occurs, the end of bolt 16 extends through ring opening 27 and into the bore hole 62, carrying with it the shavings formed by the threading action of the bolt 16 on the ring 26.

As the resin mixture 70 cures to its final solid state, the assembly 10 is held firmly in place in the bore hole 62. Upon further rotation, the bolt 16 is placed under an increasing tension in the bore hole 62 with support plate 57 exerting an upward force on rock formation 60 and lifting it by up to several inches. By bonding the assembly 10 to the rock formation 60, the resin mixture 70 resists slippage of the expanded sheath 14, thereby allowing the bolt 16 to be maintained in tension.

Figure 7:
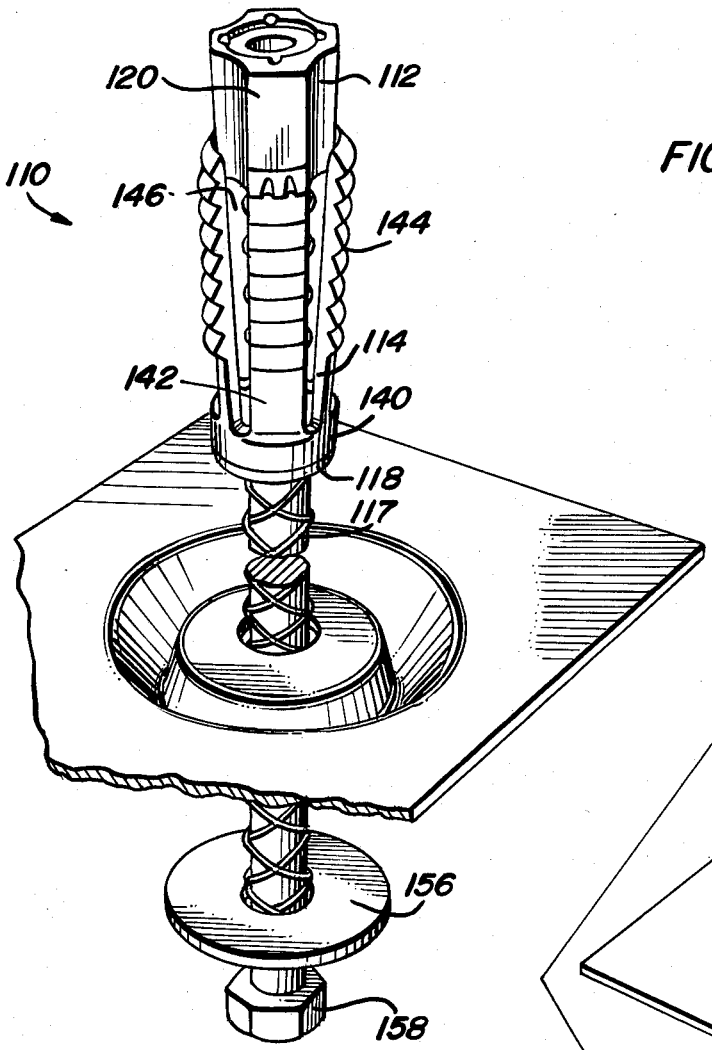
FIG. 7 is a view similar to FIG. 1 but illustrating a tensioning assembly positioned on the threaded end of a rebar.

Referring to FIG. 7, another embodiment of the present invention is shown in which like components have been identified with the same reference numeral but in the 100 series used in FIG. 1. In this embodiment, the tensioning assembly 110 is mounted on a rebar (reinforcing bar) 117. The rebar 117 is used in this embodiment in place of the bolt 16.

Figure 2:
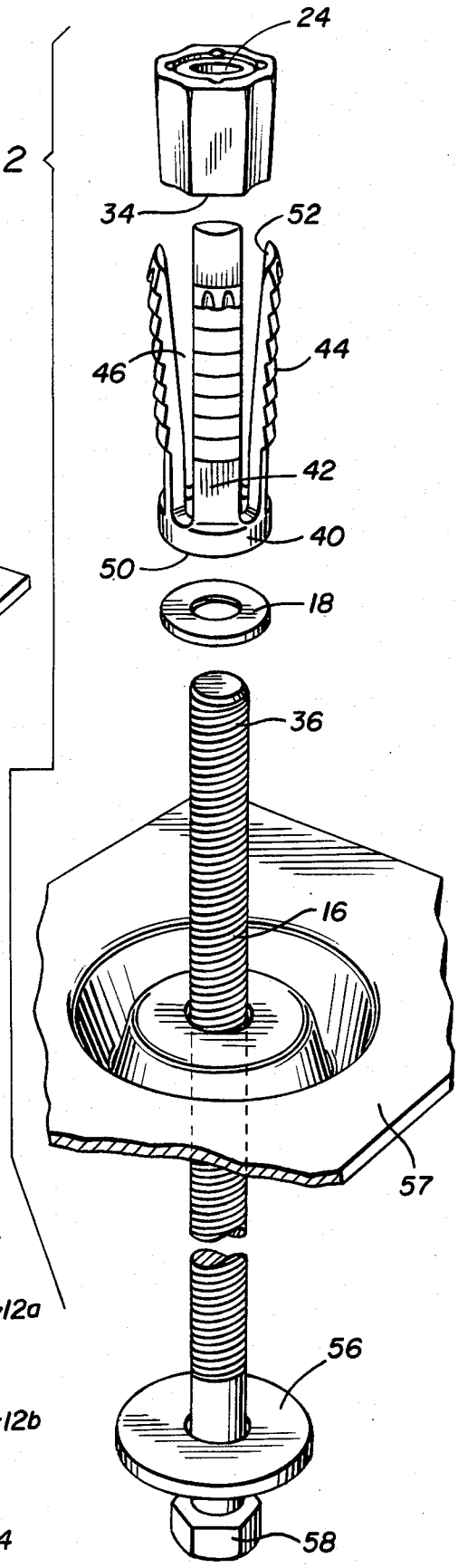
FIG. 2 is a fragmentary exploded view of the assembly of FIG. 1.
Figure 8:
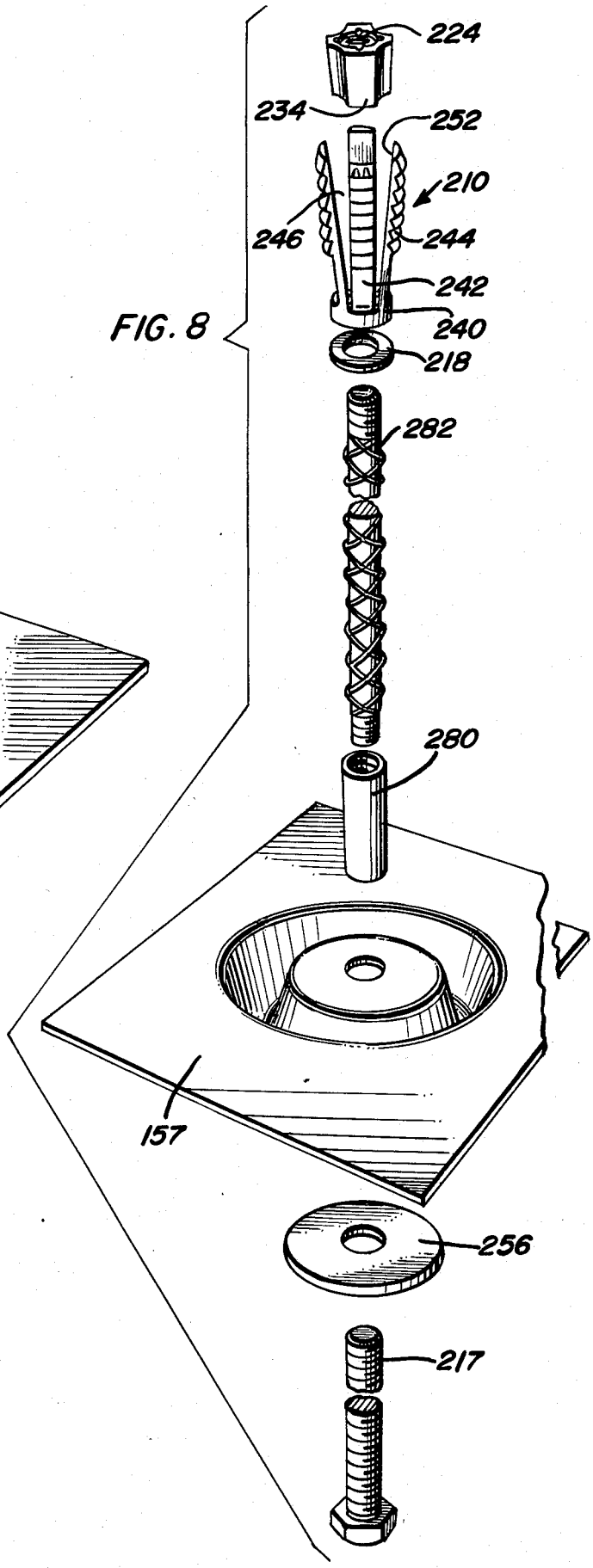
FIG. 8 is a view similar to FIG. 2 but illustrating a tensioning assembly positioned on the threaded end of a rebar which is coupled to a bolt.

In FIG. 8, similar components to those shown in FIG. 2 have been identified with the same reference numerals but in the 200 series. In FIG. 8, the tensioning assembly 210 is mounted on a rebar 282 which is, in turn, connected to a bolt 217 by a coupler 280. The rebar 282 is threaded on both ends. The coupler 280 includes internal threads (not shown) for coupling the threaded end of bolt 217 to one of the threaded ends of rebar 282. The embodiment illustrated in FIG. 8 is particularly suitable for use in mines having low seams.

Although a particular embodiment of the present invention has been illustrated and described, it will be apparent to those skilled in the art that various changes and modifications can be made without departing from the spirit and scope of the present invention. For example, the bonding agent, rather than being a resin, could be a cement and water activated hydraulic grout or the like. Also, the tensioning assembly could be of the bail type having the illustrated plug or a conical-shaped or wedge type camming plug or the like. Therefore, it is the intent to encompass within the appended claims all such changes and modifications that fall within the scope of the present invention.

What is claimed is:

1. An apparatus for anchoring a bolt in a rock formation comprising:

an elongated bolt adapted for use in a bore hole in said rock formation, said bolt having a first and second portion, said first portion being threaded;

a tensioning plug having first and second ends and inner and outer walls, said tensioning plug defining an aperture therethrough;

said tensioning plug inner wall being threaded at a first end to engage said bolt first portion, said threads having an inner surface;

resistance means affixed to said tensioning plug inner wall at said second end, said resistance means defining an opening and being coaxial with said tensioning plug;

an expandable sheath having a base and a plurality of longitudinal extensions stemming from said base, said sheath defining an aperture therethrough;

each of said extensions having an outer surface designed to engage the wall of the bore hole and an inner surface, the outer wall of said tensioning plug first end disposed adjacent the inner surface of the extensions, said tensioning plug thereby resting within the sheath aperture and being coaxial therewith, said sheath and plug being held in abutting relation;

said bolt first portion extending through said sheath aperture and said plug aperture and abutting said resistance means thereby preventing axial movement of said bolt upon application of a torque beyond a predetermined point in said tensioning plug aperture and causing said bolt, said sheath and said tensioning plug to rotate together; and said bolt threaded first portion threading into said resistance means upon application to said bolt of a torque in excess of a predetermined torque and thereby allowing relative rotation between said bolt and said tensioning plug, said plug being non-rotatably drawn axially along said bolt so as to expand said extensions to anchor the bolt in a bore hole and permit said bolt to be placed under tension in said bore hole.

2. The apparatus of claim 1, wherein said resistance means comprises a threadable ring having an inner and outer surface, said outer surface firmly secured to said plug inner wall.

3. The apparatus of claim 2, wherein said ring outer surface is adhesively attached to said plug inner wall.

4. The apparatus of claim 2, wherein upon continuous application of a predetermined torque to said bolt, the threads of said bolt cut away grooves in said ring inner surface, thereby threading into said ring and causing axial movement of said plug on said bolt.

5. The apparatus of claim 2, wherein the plug first end has an inside diameter approximately the same as the ring inside diameter and approximately the same as the outside diameter of the bolt first portion so that only the threads of the bolt first portion come into contact with said ring.

6. The apparatus of claim 2, wherein said ring is made of nylon.

7. The apparatus of claim 2, wherein said ring is made of plastic.

8. The apparatus of claim 2, wherein said ring is made of soft, malleable material.

9. The apparatus of claim 1, wherein said sheath and said plug are held in abutting relation by a pall nut.

10. The apparatus of claim 1, wherein said sheath and said plug are held in abutting relation by a bail assembly.

11. A method of anchoring a bolt in a rock formation comprising the steps of:

placing an expandable sheath, having a plurality of longitudinal extensions and defining an aperture therethrough, in abutting relation with a tensioning plug having an inner and outer wall such that said extensions contact said plug outer wall, said sheath and said plug forming a tensioning assembly;

positioning the sheath in surrounding relation with the bolt and threading the tensioning plug into the end of the bolt;

hold the sheath in place on the bolt;

inserting a bonding material in a bore hole in said rock formation;

positioning said tensioning assembly adjacent said bonding material in said bore hole;

preventing axial movement of the bolt beyond a predetermined point within said tensioning plug by a resistance means affixed to the inner wall of said tensioning plug, said resistance means defining an opening and being coaxial with said tensioning plug and abutting said bolt at said predetermined point, thereby causing said bolt and said tensioning assembly to rotate together upon application of a torque to said bolt in a predetermined direction to effect mixing of said bonding material in said bore hole;

threading said bolt into said resistance means upon application to said bolt of a torque in excess of a predetermined torque in said predetermined direction, said mixed bonding material preventing rotation of said tensioning assembly; and tensioning the bolt by continuing to rotate said bolt in said predetermined direction, said plug being non-rotatably drawn axially along said bolt so as to expand said extensions, thereby anchoring the bolt in the bore hole and maintaining the bolt in tension.

12. The method of claim 11 which includes:

preventing axial movement of the bolt beyond a predetermined point within said tensioning plug by a threadable ring firmly secured to the plug inner wall; and cutting away grooves in said ring by the bolt threads upon application to said bolt of a torque in excess of a predetermined torque in said predetermined direction.

* * * * *